US006756348B2

(12) United States Patent
Palazzotto et al.

(10) Patent No.: US 6,756,348 B2
(45) Date of Patent: Jun. 29, 2004

(54) LUBRICATING OIL HAVING ENHANCED RESISTANCE TO OXIDATION, NITRATION AND VISCOSITY INCREASE

(75) Inventors: John D. Palazzotto, Castro Valley, CA (US); Mark R. Logan, San Ramon, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 38 days.

(21) Appl. No.: 09/997,925

(22) Filed: Nov. 29, 2001

(65) Prior Publication Data

US 2003/0139304 A1 Jul. 24, 2003

(51) Int. Cl.[7] ..... C10M 161/00

(52) U.S. Cl. ..... 508/503; 508/322; 508/342; 508/502

(58) Field of Search ..... 508/502, 503, 508/322, 342

(56) References Cited

U.S. PATENT DOCUMENTS

| | | | | |
|---|---|---|---|---|
| 2,992,708 A | | 7/1961 | Lyon | |
| 3,018,250 A | | 1/1962 | Anderson et al. | |
| 3,018,291 A | | 1/1962 | Anderson et al. | |
| 3,024,237 A | | 3/1962 | Drummond et al. | |
| 3,100,673 A | | 8/1963 | Ulmer et al. | |
| 3,172,892 A | | 3/1965 | Le Suer et al. | |
| 3,189,545 A | | 5/1965 | Little, Jr. et al. | |
| 3,189,945 A | * | 6/1965 | Strauss | 425/549 |
| 3,219,666 A | | 11/1965 | Norman et al. | |
| 3,272,746 A | | 9/1966 | Le Suer et al. | |
| 3,361,673 A | | 1/1968 | Stuart et al. | |
| 3,381,022 A | | 4/1968 | Le Suer | |
| 3,912,764 A | | 10/1975 | Palmer Jr. | |
| 3,981,813 A | | 9/1976 | Herder et al. | |
| 3,992,307 A | * | 11/1976 | Hotten | 508/334 |
| 4,011,196 A | | 3/1977 | Carevic et al. | |
| 4,077,807 A | | 3/1978 | Kramer et al. | |
| 4,152,275 A | * | 5/1979 | Horodysky et al. | 508/338 |
| 4,234,435 A | | 11/1980 | Meinhardt et al. | |
| 4,341,677 A | | 7/1982 | Tamosauskas | |
| 4,360,486 A | | 11/1982 | DiBiasi et al. | |
| 4,612,132 A | | 9/1986 | Wollenberg et al. | |
| 4,654,082 A | | 3/1987 | Frilette | |
| 4,654,156 A | * | 3/1987 | Horodysky et al. | 508/236 |
| 4,747,965 A | | 5/1988 | Wollenberg et al. | |
| 4,764,295 A | | 8/1988 | Le Coent | |
| 5,112,507 A | | 5/1992 | Harrison | |
| 5,135,670 A | * | 8/1992 | Johnson et al. | 508/569 |
| 5,149,827 A | | 9/1992 | Kita et al. | |
| 5,207,940 A | * | 5/1993 | Carpenter et al. | 508/342 |
| 5,241,003 A | | 8/1993 | Degonia et al. | |
| 5,266,186 A | | 11/1993 | Kaplan | |
| 5,286,799 A | | 2/1994 | Harrison et al. | |
| 5,319,030 A | | 6/1994 | Harrison et al. | |
| 5,320,765 A | | 6/1994 | Fetterman, Jr. et al. | |
| 5,334,321 A | | 8/1994 | Harrison et al. | |
| 5,356,552 A | | 10/1994 | Harrison et al. | |
| 5,370,805 A | | 12/1994 | Smrcka et al. | |
| 5,410,088 A | * | 4/1995 | Harris et al. | 568/21 |
| 5,571,586 A | | 11/1996 | Gobran | |
| 5,575,951 A | | 11/1996 | Anderson | |
| 5,595,964 A | | 1/1997 | Bardasz | |
| 5,629,063 A | | 5/1997 | Gobran | |
| 5,652,201 A | | 7/1997 | Papay et al. | |
| 5,716,912 A | | 2/1998 | Harrison et al. | |
| 5,726,133 A | | 3/1998 | Blahey et al. | |
| 5,773,391 A | | 6/1998 | Lawate et al. | |
| 5,851,743 A | | 12/1998 | Akao | |
| 5,922,794 A | | 7/1999 | Prabhu et al. | |
| 5,958,849 A | * | 9/1999 | Hewson et al. | 508/345 |
| 5,994,279 A | | 11/1999 | Felsky et al. | |
| 5,998,119 A | | 12/1999 | Aylward et al. | |
| 6,030,929 A | | 2/2000 | Pudelski | |
| 6,034,040 A | | 3/2000 | Ozbalik et al. | |
| 6,124,249 A | | 9/2000 | Seebauer et al. | |
| 6,140,281 A | | 10/2000 | Blahey et al. | |
| 6,140,282 A | | 10/2000 | Cartwright et al. | |
| 6,147,035 A | | 11/2000 | Sougawa et al. | |
| 6,184,186 B1 | | 2/2001 | Ryan et al. | |
| 6,191,081 B1 | | 2/2001 | Cartwright et al. | |
| 6,211,122 B1 | | 4/2001 | Pudelski et al. | |
| 6,271,184 B1 | | 8/2001 | Seebauer et al. | |
| 6,300,290 B1 | | 10/2001 | L'Heureux et al. | |

FOREIGN PATENT DOCUMENTS

| | | |
|---|---|---|
| EP | 0 391 651 A3 | 10/1990 |
| EP | 0 391 651 B1 | 10/1990 |
| EP | 0 391 651 A2 | 10/1990 |
| WO | WO 00/22070 | 4/2000 |

OTHER PUBLICATIONS

Chevron SS15633 was offered for sale by Chevron Lubricants and Speciality Products in Houston, Texas on Jan. 7, 2000. Chevron SS15633 contains a combination antioxidant about 0.5 wt. % hindered phenol and about 0.5 wt. % of molybdenum sulfide oxidation inhibitor such as that described in U.S. patent 4,263,152 in a Group II base oil.

www.cromptoncorp.com. Crompton Olefins & Styrenics Additives, "Polyol Stabilizers" Product Information (Naugard®PS–48), 11/20.01.

Ciba Specialty Chemicals Inc., Additives, Reference AD7, Publ. No. 28970/96/e, "Ciba® IRGANOX® L 135", 1996.

* cited by examiner

*Primary Examiner*—Jacqueline V. Howard
(74) *Attorney, Agent, or Firm*—Martin Fallon; Josetta Jones; Linda Stokley

(57) ABSTRACT

This invention is directed to an antioxidant system for use in lubricating oils comprising sulfurized isobutylene and hindered phenols that provides enhanced oxidation resistance and is particularly useful in natural gas fueled engines, the method for making this antioxidant system, lubricating oils comprising the antioxidant system and methods for lubricating engines using lubricating oil comprising this antioxidant system.

57 Claims, No Drawings

LUBRICATING OIL HAVING ENHANCED RESISTANCE TO OXIDATION, NITRATION AND VISCOSITY INCREASE

BACKGROUND

This invention relates to an antioxidant system and lubricating oil comprising the antioxidant system. The lubricating oil of this invention may be used as a lubricant for any lubricating application, however its enhanced properties makes it particularly applicable for use as a lubricant for natural gas fueled engines.

Natural gas fueled engines are engines that use natural gas as a fuel source. Lubricating oil with high resistance to oxidation, nitration and viscosity increase is preferred for lubricating oils used in natural gas engines because of the conditions related to this type of engine.

Natural gas has a higher specific heat content than liquid hydrocarbon fuels and therefore it burns hotter than liquid hydrocarbon fuels under typical conditions. In addition, since it is already a gas, natural gas does not cool the intake air by evaporation as liquid hydrocarbon fuel droplets do. Furthermore, many natural gas fueled engines are run either at or near stoichiometric conditions, where less excess air is available to dilute and cool combustion gases. As a result, natural gas fueled engines generate higher combustion gas temperatures than engines burning liquid hydrocarbon fuels. Since the rate of formation of $NO_x$ increases exponentially with temperature, natural gas fueled engines may generate $NO_x$ concentrations high enough to cause severe nitration of lubricating oil.

In most cases, natural gas fueled engines are used continuously at 70 to 100% load, whereas an engine operating in vehicular service may only spend 50% of its time at full load. Lubricating oil drain intervals may vary in vehicular service, but are typically shorter than those for natural gas fueled engines.

Natural gas fueled engines may be located in remote areas where service is not readily available and may be expensive. Because of this it is important to ensure the reliability of natural gas fueled engines. High resistance to oxidation and nitration is therefore required for lubricating oils used in natural gas engines.

Good valve wear control is important for keeping engine operating costs down and may be achieved by providing the proper amount and composition of ash. Minimizing combustion chamber deposits and spark plug fouling are also considerations in setting the ash content and composition in these oils. Lubricating oil ash levels are limited, so detergents must be carefully selected to minimize piston deposits and ring sticking. Good wear protection is required to prevent scuffing and corrosion.

If lubricating oils for natural gas fueled engines are not formulated to handle typical environments for those engines, the lubricating oil will deteriorate rapidly during use. This deterioration will typically cause the lubricating oil to thicken which results in engine sludge, piston deposits, oil filter plugging, and in severe cases, accelerated ring and liner wear.

The general industry approach to reduce deterioration of lubricating oil and the resultant engine sludge, piston deposits, oil filter plugging and accelerated ring and liner wear is to add antioxidants such as hindered phenols as well as diphenyl amines and sulfurized compounds. Increasing the amount of these antioxidants in lubricating oil is increasingly effective to avoid lubricating oil deterioration. But at some point the solubility limit of the additive reaches maximum effectiveness and detrimental effects can be also noticed in piston deposit control.

While it is no surprise that increasing the amount of antioxidant is effective in increasing the antioxidant properties of a finished oil, the antioxidant system of this invention provides a method to enhance the antioxidant properties without increasing the amount of antioxidant. This method involves use of an antioxidant system that comprises sulfurized isobutylene and an antioxidant system that comprises sulfurized isobutylene and hindered phenol.

SUMMARY

One embodiment of this invention comprises an antioxidant system comprising sulfurized isobutylene. Another embodiment of this invention comprises an antioxidant system comprising sulfurized isobutylene and one or more hindered phenols. The hindered phenols of this antioxidant system may comprise butylated hydroxy toluene (BHT), 3,5-di-t-butyl 4-hydroxy phenol propionate and one or more antioxidants have the general formula:

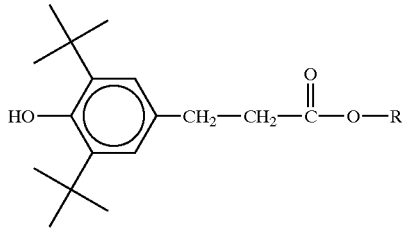

wherein R is a $C_7$ to $C_9$ alkyl group.

Another embodiment of this invention is an additive formulation comprising one or more of the additive systems of this invention and other additives.

The lubricating oil of this invention may comprise base oil and one or more of the additive formulations of this invention. The lubricating oil of this invention may comprise base oil and one or more of the additive systems of this invention. One embodiment of this invention may comprise a method of lubricating engines comprising contacting one or more of the lubricating oils of this invention with one or more engines. One embodiment of this invention may comprise a method of lubricating natural gas fueled engines comprising contacting one or more of the lubricating oils of this invention with one or more natural gas fueled engines. This invention comprises methods for making any embodiments of the lubricating oil or additive systems or additive formulations of this invention comprising combining the components in any order at a temperature sufficient to encourage mixing of the components, but not sufficient to degrade the components. This invention comprises methods for making any embodiments of the lubricating oil of this invention comprising combining the components in any order at a temperature of about 140 degrees F.

DETAILED DESCRIPTION OF THE INVENTION

This invention is directed to one or more antioxidant systems for use in lubricating oils. One embodiment of the invention may be lubricating oil that comprises sulfurized isobutylene as an antioxidant. Another embodiment of the invention may be an additive formulation that comprises sulfurized isobutylene as an antioxidant, and one or more dispersants, one or more detergents, and one or more wear inhibitors. Another embodiment of this invention may be lubricating oil comprising one or more of the antioxidant systems of this invention. Another embodiment of this invention may be a lubricating oil comprising one or more of the additive formulations of this invention. These antioxidant systems, additive formulations and lubricating oils may be particularly useful in natural gas fueled engines.

Another embodiment of the invention may be lubricating oil that comprises sulfurized isobutylene in combination with an antioxidant such as hindered phenol. One embodiment of the invention may be an additive formulation that comprises sulfurized isobutylene, an antioxidant such as hindered phenol, and one or more dispersants, one or more detergents, and one or more wear inhibitors. Another embodiment of this invention may be lubricating oil comprising one or more of the antioxidant systems of this invention. Another embodiment of this invention may be lubricating oil comprising one or more of the additive formulations of this invention. These antioxidant systems, additive formulations and lubricating oils may be particularly useful in natural gas fueled engines.

Another embodiment of this invention may be a method to make a lubricating oil comprising the antioxidant systems of this invention by combining the components and mixing them together and heating at a temperature sufficient to encourage mixing of the components, but not sufficient to degrade the components. Another embodiment of this invention is a method of using the lubricating oils of this invention to lubricate an engine by contacting the engine with the lubricating oil of this invention. Another embodiment of this invention is a method of using the lubricating oils of this invention to lubricate a natural gas engine by contacting a natural gas engine with the lubricating oil of this invention.

I. Antioxidant System

One embodiment of the antioxidant system of this invention may comprise sulfurized isobutylene. Lubricating oils of this invention may comprise this additive system. Lubricating oil comprising this antioxidant system may comprise about 0.02 wt. % to about 2 wt. % sulfurized isobutylene.

Another embodiment of the antioxidant system of this invention may comprise the hindered phenols described herein and sulfurized isobutylene. Lubricating oils of this invention may comprise this additive system. The preferred concentration ratio of the sulfurized isobutylene to the hindered phenol of this antioxidant system may be about 0.002 to about 2.5, more preferred about 0.004 to about 1.13. A lubricating oil comprising this antioxidant system may comprise about 0.21 wt. % to about 6.50 wt. %, more preferably about 0.42 wt. % to about 5.45 wt. % of an antioxidant system comprising sulfurized isobutylene and one or more hindered phenols described herein.

When wt. % is used herein it is refers to wt. % of lubricating oil unless otherwise defined.

A. Sulfurized Isobutylene

Sulfurized isobutylene is known by those skilled in the art to be an extreme pressure agent, effective in preventing wear in high pressure environments such as gear lubrication. This invention is based on the finding that when sulfurized isobutylene is used alone or in combination with traditional antioxidants such as hindered phenols, there is an improvement in oxidation, nitration and percent viscosity increase measurements. Using sulfurized isobutylene in a lubricant for engines and for natural gas fueled engines in particular is different than using sulfurized isobutylene as an extreme pressure agent in lubricating oil for gear applications. Sulfurized isobutylene used as an anti wear agent in gear applications is not typically exposed to combustion gases and water, whereas sulfurized isobutylene used as an antioxidant in lubricants for natural gas fueled engines or any engine may typically be exposed to combustion gases and water in the form of condensation.

Sulfurized isobutylene comprises a long chain hydrocarbon that is reacted with a various sulfur compounds that are incorporated into the chain. This provides an oil soluble compound that is effective in providing extreme pressure (EP) protection.

Sulfurized isobutylene for use in certain embodiments of this invention may include one or more of sulfurized isobutylenes such as Mobilad C-100 and R. T. Vanderbilt Vanlube SB. One embodiment of the invention may be a lubricating oil that comprises less than about 2 wt. % sulfurized isobutylene.

One embodiment of the lubricating oil of this invention may comprise an antioxidant system comprising about 0.02 wt. % to about 2 wt. % sulfurized isobutylene or preferably about 0.04 wt. % to about 1.75 wt. % sulfurized isobutylene. Another embodiment of the lubricating oil of this invention may comprise an antioxidant system comprising the hindered phenols described herein and about 0.01 weight percent (wt. %) to about 0.5 wt. %, more preferably from about 0.02 wt. % to about 0.45 wt. % sulfurized isobutylene.

B. Hindered Phenol

Embodiments of this invention may comprise hindered phenols. Liquid hindered phenols are preferred. Preferred hindered phenols include one or more hindered phenols having the general formula:

(1)

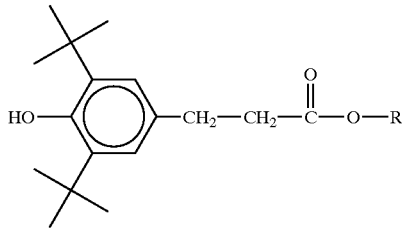

wherein R is a $C_7$ to $C_9$ alkyl group.

The lubricating oil of this invention may comprise about 0.10 wt. % to about 3.0 wt. %, preferably from about 0.20 wt. % to about 2.50 wt. % of one or more hindered phenols of the general formula (1).

A preferred antioxidant system of this invention comprises 3,5-di-t-butyl 4-hydroxy phenol propionate. The lubricating oil of this invention may comprise about 0.10 wt. % to about 3.0 wt. %, preferably from about 0.20 wt. % to about 2.50 wt. % 3,5-di-t-butyl 4-hydroxy phenol propionate.

A most preferred antioxidant of this invention is commercially available from Ciba Specialty Chemicals at 540 White Plains Road, Tarrytown, N.Y. 10591 as IRGANOX L 135® or Crompton Corporation at 199 Benson Road, Middlebury, Conn. 06749 as Naugard®PS-48. IRGANOX L 135® and Naugard®PS-48 are liquid high molecular weight phenolic antioxidants. The lubricating oil of this invention may comprise about 0.10 wt % to about 3.0 wt %, preferably from about 0.20 wt % to about 2.50 wt % of IRGANOX L 135®. Both Nauciard®PS-48 and IRGANOX L 135® are available to the public. Both compounds are represented by formula (1) wherein R is a $C_7$ to $C_9$ alkyl group.

Embodiments of this invention may comprise butylated hydroxy toluene (BHT). The lubricating oil of this invention may comprise about 0.10 wt. % to about 3.0 wt. % BHT and preferably about 0.20 wt. % to about 2.50 wt. % BHT.

The lubricating oil of this invention may comprise combined BHT and other hindered phenols described herein. This combination may be present in about 0.20 wt. % to about 6.00 wt. %, more preferably about 0.40 wt. % to about 5.00 wt. % of the finished oil.

II. Additive Formulation

When incorporated in lubricating oil, certain embodiments of the additive formulation of this invention may provide enhanced oxidation inhibition, nitration inhibition, total base retention, reduction in acid formation and reduction in percent viscosity increase. The additive formulation of this invention may comprise one or more of the antioxidant systems described herein.

Another embodiment of the additive formulation of this invention may comprise butylated hydroxy toluene, sulfurized isobutylene, one or more detergents, one or more dispersants, one or more wear inhibitors and one or more of 3,5-di-t-butyl 4-hydroxy phenol propionate and hindered phenols having the general formula (1). Other traditional additives may be used.

Another embodiment of the additive formulation of this invention may comprise sulfurized isobutylene, one or more detergents, one or more dispersants and one or more wear inhibitors. Other traditional additives may be used.

Another embodiment of the additive formulation of this invention may comprise sulfurized isobutylene, one or more detergents, one or more dispersants, one or more wear inhibitors and one or more of 3,5-di-t-butyl 4-hydroxy phenol propionate and hindered phenols having the general formula (1). Other traditional additives may be used.

The additive formulation of this invention may comprise diluent oil. It is known in the art to add diluent oil to additive formulations and this is called "trimming" the additive formulation. A preferred embodiment may be trimmed with any diluent oil typically used in the industry. This diluent oil may be a Group I, II, III, IV or V oil. A preferred amount of diluent oil may comprise about 4.00 wt. %.

III. Other Additive Components

The following additive components are examples of some of the components that may be favorably employed in the present invention in addition to the antioxidant system of this invention. These examples of additives are provided to illustrate the present invention, but they are not intended to limit it.

A. Detergent

Any detergents commonly used in lubricating oils may be used in this invention. These detergents may or may not be overbased detergents or they may be low, neutral, medium, or high overbased detergents. For example, detergents of this invention may comprise sulfonates, salicylates and phenates. Metal sulfonates, salicylates and phenates are preferred. When the term metal is used with respect to sulfonates, salicylates and phenates herein, it refers to calcium, magnesium, lithium, magnesium, potassium and barium.

The lubricating oil of this invention may comprise about 1.0 wt. % to about 8.5 wt. %, preferably about 2 wt. % to about 6 wt. % of one or more detergents.

B. Additional Antioxidants

If desired, additional antioxidants may be used. Other antioxidants may reduce the tendency of mineral oils to deteriorate in service. In addition to the antioxidant systems of this invention, the additive formulation may also include but is not limited to such antioxidants as phenol type (phenolic) oxidation inhibitors, such as 4,4'-methylene-bis (2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-I-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-.alpha.-naphthylamine, and alkylated-.alpha.-naphthylamine. Other types of oxidation inhibitors include metal dithiocarbamate (e.g., zinc dithiocarbamate), and methylenebis (dibutyldithiocarbamate).

C. Wear Inhibitors

Traditional wear inhibitors may be used in this invention. As their name implies, these agents reduce wear of moving metallic parts. Examples of such agents include, but are not limited to phosphates, phosphites, carbamates, esters, sulfur containing compounds, and molybdenum complexes. The finished lubricating oil of this invention may comprise one or more wear inhibitors such metal dithiophospates and metal dithiocarbamates or mixtures thereof. A preferred wear inhibitor for use in this invention comprises zinc dithiophosphate. Lubricating oil of this invention may comprise about 0.2 wt. % to about 1.5 wt. % or preferably about 0.3 wt. % to about 0.8 wt. % of one or more wear inhibitors.

D. Rust Inhibitors (Anti-Rust Agents)

Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate may be used.

Other compounds such as stearic acid and other fatty acids, dicarboxylic acids, metal soaps, fatty acid amine salts, metal salts of heavy sulfonic acid, partial carboxylic acid ester of polyhydric alcohol, and phosphoric ester may be used.

E. Demulsifiers

Addition product of alkylphenol and ethylene oxide, polyoxyethylene alkyl ether, and polyoxyethylene sorbitan ester may be used.

F. Extreme Pressure Agents (EP Agents)

Zinc dialkyldithiophosphate (primary alkyl, secondary alkyl, and aryl type), sulfurized oils, diphenyl sulfide, methyl trichlorostearate, chlorinated naphthalene, fluoroalkylpolysiloxane, and lead naphthenate may be used.

G. Friction Modifiers

Fatty alcohol, fatty acid, amine, borated ester, and other esters may be used.

H. Multifunctional Additives

Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound may be used.

I. Viscosity Index Improvers

Polymethacrylate type polymers, ethylene-propylene copolymers, styrene-isoprene copolymers, hydrated styrene-isoprene copolymers, polyisobutylene, and dispersant type viscosity index improve may be used.

J. Pour Point Depressants

Polymethyl methacrylate may be used.

K. Foam Inhibitors

Alkyl methacrylate polymers and dimethyl silicone polymers may be used

L. Dispersants

A preferred embodiment of the lubricating oil of this invention may comprise one or more nitrogen containing dispersants of the type generally represented by succinimides (e.g., polyisobutylene succinic acid/anhydride (PIBSA)-polyamine having a PIBSA molecular weight of about 700 to 2500). The dispersants may be borated or non-borated, ashless or ash containing. Lubricating oils of this invention may comprise about 1 wt. % to about 8 wt. % or more preferably about 1.5 wt. % to about 6 wt of one or more dispersants.

Preferred dispersants for this invention comprise one or more dispersants having an average molecular weight (mw) of about 1000 to about 5000. Dispersants prepared from polyisobutylene (PIB) having a mw of about 1000 to about 5000 are such preferred dispersants.

A preferred dispersant of this invention may be a one or more succinimides. The term "succinimide" is understood in the art to include many of the amide, imide, etc. species that are also formed by the reaction of a succinic anhydride with an amine and is so used herein. The predominant product, however, is succinimide and this term has been generally accepted as meaning the product of a reaction of an alkenyl- or alkyl-substituted succinic acid or anhydride with a polyamine. Alkenyl or alkyl succinimides are disclosed in numerous references and are well known in the art. Certain fundamental types of succinimides and related materials encompassed by the term of art "succinimide" are taught in U.S. Pat. Nos. 2,992,708; 3,018,250; 3,018,291; 3,024,237; 3,100,673; 3,172,892; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are hereby incorporated by reference.

This invention may comprise one or more succinimides, which may be either a mono or bis-succinimide. This invention may comprise lubricating oil involving one or more succinimide dispersants that have or have not been post treated.

IV. Group I, II, III, IV and V Base Oil

Base Oil as used herein is defined as a base stock or blend of base stocks. Base Stock as used herein is defined as a lubricant component that is produced by a single manufacturer to the same specifications (independent of feed source or manufacturers location that meets the same manufacturer's specification and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 100 degrees Centigrade (C) and about 5 centistokes (cSt) to about 20 cSt, preferably about 7 cSt to about 16 cSt, more preferably about 9 cSt to about 15 cSt. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity 20 cSt or higher at 100 degrees C.

The base oil may be derived from natural lubricating oils, synthetic lubricating oils or mixtures thereof. Suitable base oil includes base stocks obtained by isomerization of synthetic wax and slack wax, as well as hydrocrackate base stocks produced by hydrocracking (rather than solvent extracting) the aromatic and polar components of the crude. Suitable base oils include those in API categories I II, III, and IV. Saturates levels and viscosity indices for Group I, II and III base oils are listed in Table 1. Group IV base oils are polyalphaolefins (PAO). Group V base oils include all other base oils not included in Group I, II, III, or IV. Suitable base oils may include those in API categories I, I, III, and IV as defined in API Publication 1509, $14^{th}$ Edition Addendum I, December 1998.

TABLE 1

Saturates, Sulfur and Viscosity Index of Group I, II and III Base Stocks

| Group | Saturates (As determined by ASTM D 2007) Sulfur (As determined by ASTM D 2270) | Viscosity Index (As determined by ASTM D 4294, ASTM D 4297 or ASTM D 3120) |
|---|---|---|
| I | Less than 90% saturates and/or Greater than to 0.03% sulfur | Greater than or equal to 80 and less than 120 |
| II | Greater than or equal to 90% saturates and less than or equal to 0.03% sulfur | Greater than or equal to 80 and less than 120 |
| III | Greater than or equal to 90% saturates and less than or equal to 0.03% sulfur | Greater than or equal to 120 |

Natural lubricating oils may include animal oils, vegetable oils (e.g., rapeseed oils, castor oils and lard oil), petroleum oils, mineral oils, and oils derived from coal or shale.

Synthetic oils may include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Trialkyl phosphate ester oils such as those exemplified by tri-n-butyl phosphate and tri-iso-butyl phosphate are also suitable for use as base oils.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

It is preferred to use a major amount of base oil in the lubricating oil of this invention. A preferred range of base oil for this invention may be about 80 wt. % to about 97 wt. % of the lubricating oil. (When wt. % is used herein, it is referring to wt. % of the lubricating oil unless otherwise specified.) A more preferred embodiment of this invention may comprise an amount of base oil that comprises about 85 wt. % to about 95 wt. % of the lubricating oil.

V. Finished Lubricating Oil Comprising the Additive Formulation

The following embodiments of finished lubricating oils are illustrative only. The invention is not limited to these embodiments.

One embodiment of the lubricating oil of this invention may comprise lubricating oil, the hindered phenols described herein and sulfurized isobutylene. The components of the antioxidant systems of this invention and other additives traditionally used in the industry may be incorporated in lubricating oil in any manor either individually or in any combination.

One embodiment of the lubricating oil of this invention may comprise about 0.21 wt. % to about 6.5 wt. %, more preferably about 0.42 wt. % to about 5.45 wt. % of one or more of the antioxidant systems of this invention comprising the hindered phenols described herein and sulfurized isobutylene. Other additives traditionally used in the art may be included in the finished lubricating oil of this invention.

One embodiment of the lubricating oil of this invention comprises a major amount of one or more base oils, about 1 wt. % to about 8 wt. % of one or more dispersants; about 1 wt. % to about 8.5 wt. % of one or more detergents, about 0.2 wt. % to about 1.25 wt. % of one or more wear inhibitors, about 0.01 wt. % to about 0.5 wt. % sulfurized isobutylene, and about 0.2 wt. % to about 6 wt. % of one or more of the hindered phenols described herein. This embodiment may be prepared by combining the components with agitation until all components are mixed. The ingredients may be combined in any order and at a temperature sufficient to blend the components but not high enough to degrade the components. A temperature of about 120 degrees F. to about 160 degrees F. may be used. It does not matter whether the components are heated before after or during combining them.

One embodiment of the lubricating oil of this invention comprises a major amount of one or more base oils, about 1.25 wt. % to about 6 wt. % of one or more dispersants; about 2 wt. % to about 6 wt. % of one or more detergents, about 0.3 wt. % to about 0.8 wt. % of one or more wear inhibitors, about 0.02 wt. % to about 0.45 wt. % sulfurized isobutylene, and about 0.4 wt. % to about 5 wt. % of one or more of the hindered phenols described herein. This embodiment may be prepared by combining the components with agitation until all components are mixed. The ingredients may be combined in any order and at a temperature sufficient to blend the components but not high enough to degrade the components. A temperature of about 120 degrees F. to about 160 degrees F. may be used. It does not matter whether the components are heated before after or during combining them.

One embodiment of the lubricating oil of this invention comprises lubricating oil comprising a major amount of one or more base oils, about 1 wt. % to about 8 wt. % of one or more dispersants, about 1 wt. % to about 8.5 wt. % of one or more detergents, about 0.2 wt. % to about 1.25 wt. % of one or more wear inhibitors, and about 0.02 wt. % to about 2 wt. % sulfurized isobutylene. This embodiment may be prepared by combining the components with agitation until all components are mixed. The ingredients may be combined in any order and at a temperature sufficient to blend the components but not high enough to degrade the components. A temperature of about 120 degrees F. to about 160 degrees F. may be used. It does not matter whether the components are heated before after or during combining them.

One embodiment of the lubricating oil of this invention comprises lubricating oil comprising a major amount of one or more base oils, about 1.25 wt. % to about 6 wt. % of one or more dispersants, about 2 wt. % to about 6 wt. % of one or more detergents, about 0.3 wt. % to about 0.8 wt. % of one or more wear inhibitors, and about 0.04 wt. % to about 1.75 wt. % sulfurized isobutylene. This embodiment may be prepared by combining the components with agitation until all components are mixed. The ingredients may be combined in any order and at a temperature sufficient to blend the components but not high enough to degrade the components. A temperature of about 120 degrees F. to about 160 degrees F. may be used. It does not matter whether the components are heated before after or during combining them.

One embodiment of the lubricating oil of this invention may have a Total Base Number (TBN) of about 2.15 milligrams Potassium Hydroxide per gram of sample (mg KOH/gr) to about 8.88 mg KOH/gr. A more preferable embodiment would have a TBN from about 3.00 mg KOH/gr to about 8.00 mg KOH/gr. Unless otherwise specified, TBN, as used herein, is determined by using the method ASTM D2896.

Another embodiment of this invention may comprise a method of lubricating engines comprising contacting one or more engines with any embodiment of the lubricating oil of this invention.

Another embodiment of this invention comprises a method of lubricating natural gas engines comprising contacting one or more natural gas engines with any embodiment of the lubricating oil of this invention.

Another embodiment of this invention comprises a method of lubricating engines comprising lubricating one or more engines with any embodiment of the lubricating oil of this invention.

Another embodiment of this invention comprises a method of lubricating natural gas engines comprising lubricating one or more natural gas engines with any embodiment of the lubricating oil of this invention.

Another embodiment of this invention comprises combining the components of any embodiment of lubricating oil of this invention. This embodiment may be accomplished by combining the components with agitation until all components are mixed. The ingredients may be combined in any order and at a temperature sufficient to blend the components but not high enough to degrade the components. A temperature of about 120 degrees F. to about 160 degrees F. may be used. It does not matter whether the components are heated before after or during combining them.

VI. Lubricating Oil for Natural Gas Fueled Engines

There is a difference in the lubricating oil requirements for natural gas fueled engines and engines that are fueled by liquid hydrocarbon fuels. The combustion of liquid hydrocarbon fuels such as diesel fuel often results in a small amount of incomplete combustion (e.g., exhaust particulates). In a liquid hydrocarbon fueled engine, these incombustibles provide a small but critical degree of lubrication to the exhaust valve/seat interface, thereby ensuring the durability of both cylinder heads and valves. The combustion of natural gas fuel is often very complete, with virtually no incombustible materials. Therefore, the durability of the cylinder head and valve is controlled by the ash content and other properties of the lubricating oil and its consumption rate. There are no incombustible materials to aid in lubrication to the exhaust valve/seat interface in a natural gas fueled engine. Natural gas fueled engines burn fuel that is introduced to the combustion chamber in the gaseous phase. This has a significant affect on the intake and exhaust valves because there is no fuel-derived lubricant for the valves like liquid droplets or soot. Consequently, gas engines are solely dependent on the lubricant ash to provide lubricant between the hot valve face and its mating seat. Too little ash or the wrong type can accelerate valve and seat wear, while too much ash may lead to valve guttering and subsequent valve torching. Too much ash can also lead to detonation from combustion chamber deposits. Consequently, gas engine builders frequently specify a narrow ash range that they have learned provides the optimum performance. Since most gas is low in sulfur, excess ash is generally not needed to address alkalinity requirements, and ash levels are largely optimized around the needs of the valves. There may be exceptions to this in cases where sour gas or landfill gas is used.

Natural gas fueled engine lubricating oils are classified according to their ash content. Unless otherwise specified, ash contents discussed herein were determined by ASTM D874. The lubricant ash acts as a solid lubricant to protect the valve/seat interface in place of naturally occurring exhaust particles in a hydrocarbon fueled engine. The oil industry has accepted guidelines that classify natural gas fueled engine lubricating oil according to their ash level. The classifications of natural gas fueled engine lubricating oil according to their ash levels are presented in Table 2.

TABLE 2

Classifications of Lubricating Oils for Natural Gas Fueled Engines According To Ash Levels

| Ash Designation | Sulfated Ash Level (wt. %. Determined by ASTM D874) |
|---|---|
| Ashless | 0 < Ash < 0.15 |
| Low Ash | 0.15 < Ash < 0.6 |
| Medium Ash | 0.6 < Ash < 1.0 |
| High Ash | Ash > 1.0 |

The ash level of lubricating oil is often determined by its formulation components. Metal-containing detergents (e.g., barium, calcium) and metallic-containing wear inhibitors contribute to the ash level of lubricating oils. For correct engine operation, gas engine manufacturers define lubricating oil ash requirements as part of the lubricating oil specifications. For example, manufacturers of 2-cycle engines often require natural gas engine lubricating oil to be Ashless to minimize the extent of harmful deposits that form on the piston and combustion chamber area. Manufacturers of 4-cycle engines often require natural gas engine lubricating oils to be Low, Medium or High Ash levels, refer to Table 2, to provide the correct balance of engine cleanliness and durability of the cylinder head and valves. Running the engine with lubricating oil with too low an ash level will likely result in shortened life for the valves or cylinder head. Running the engine with lubricating oil having too high an ash level will likely cause excessive deposits in the combustion chamber and upper piston area.

The degree of nitration of the lubricating oil may vary significantly depending on the engine design and operating conditions. Lean burn engines produce less $NO_x$ than their stoichiometric counterparts, so they tend to nitrate the oils less. Some operators may richen the air/fuel mixture on natural gas fueled engines to increase power output and consequently increase oil nitration levels. Lubricating oils with good nitration resistance are required in most natural gas engine installations because the lubricating oil may be used to lubricate a number of engines including stoichiometric and lean-burn models.

This invention will be further illustrated by the following examples that set forth particularly preferred embodiments. While the examples are provided to illustrate this invention, they are not intended to limit it.

EXAMPLES

These examples describe experiments performed using Samples A through L. Multiple experiments were performed in each example using a variety of sulfonate, phenate and salicylate detergents; succinimide dispersants; and zinc dithiophosphate wear inhibitors. The examples are explained using the terms detergent, dispersant and wear inhibitor because no significant difference was found when these components were varied.

Sample A was prepared by combining about 0.757 wt. % 3,5-di-t-butyl 4-hydroxy phenol propionate, about 3.3 wt. % dispersant, about 3.0 wt. % detergent, about 1.0 wt. % butylated hydroxy toluene, about 0.38 wt. % wear inhibitor, about 5 ppm foam inhibitor and Group I base oil with agitation until all components were mixed. The ingredients were combined at a temperature sufficient to blend the components but not high enough to degrade the components. A temperature of about 140 degrees F. was used.

Sample B was prepared by combining about 0.693 wt. % 3,5-di-t-butyl 4-hydroxy phenol propionate, about 3.3 wt. % dispersant, about 3.0 wt. % detergent, about 1.0 wt. % butylated hydroxy toluene, about 0.38 wt. % wear inhibitor, about 0.08 wt. % sulfurized isobutylene, about 5 ppm foam inhibitor and Group I base oil with agitation until all components were mixed. The ingredients were combined at a temperature sufficient to blend the components but not high enough to degrade the components. A temperature of about 140 degrees F. was used.

Sample C was prepared by combining about 0.629 wt. % 3,5-di-t-butyl 4-hydroxy phenol propionate, about 3.3 wt. % dispersant, about 3.0 wt. % detergent, about 1.0 wt. % butylated hydroxy toluene, about 0.38 wt. % wear inhibitor, about 0.16 wt. % sulfurized isobutylene, about 5 ppm foam inhibitor and Group I base oil with agitation until all components were mixed. The ingredients were combined at a temperature sufficient to blend the components but not high enough to degrade the components. A temperature of about 140 degrees F. was used.

Sample D was prepared by combining about 0.56 wt. % 3,5-di-t-butyl 4-hydroxy phenol propionate, about 3.3 wt. % dispersant, about 3.0 wt. % detergent, about 1.0 wt. % butylated hydroxy toluene, about 0.38 wt. % wear inhibitor, about 0.25 wt. % sulfurized isobutylene, about 5 ppm foam inhibitor and Group I base oil with agitation until all components were mixed. The ingredients were combined at a temperature sufficient to blend the components but not high enough to degrade the components. A temperature of about 140 degrees F. was used.

Sample E was prepared by combining about 0.674 wt. % 3,5-di-t-butyl 4-hydroxy phenol propionate, about 3.3 wt. % dispersant, about 3.0 wt. % detergent, about 1.0 wt. % butylated hydroxy toluene, about 0.38 wt. % wear inhibitor, about 0.08 wt. % sulfurized isobutylene, about 5 ppm foam inhibitor and Group I base oil with agitation until all components were mixed. The ingredients were combined at a temperature sufficient to blend the components but not high enough to degrade the components. A temperature of about 140 degrees F. was used.

Sample F was prepared by combining about 0.592 wt. % 3,5-di-t-butyl 4-hydroxy phenol propionate, about 3.3 wt. % dispersant, about 3.0 wt. % detergent, about 1.0 wt. % butylated hydroxy toluene, about 0.38 wt. % wear inhibitor, about 0.16 wt. % sulfurized isobutylene, about 5 ppm foam inhibitor and Group I base oil with agitation until all components were mixed. The ingredients were combined at a temperature sufficient to blend the components but not high enough to degrade the components. A temperature of about 140 degrees F. was used.

Sample G was prepared by combining about 0.499 wt. % 3,5-di-t-butyl 4-hydroxy phenol propionate, about 3.3 wt. % dispersant, about 3.0 wt. % detergent, about 1.0 wt. % butylated hydroxy toluene, about 0.38 wt. % wear inhibitor, about 0.25 wt. % sulfurized isobutylene, about 5 ppm foam inhibitor and Group I base oil with agitation until all components are mixed. The ingredients were combined at a temperature sufficient to blend the components but not high enough to degrade the components. A temperature of about 140 degrees F. was used.

Sample H was prepared by using OLOA 1255, commercially available from Chevron Oronite Company in Houston, Tex. The OLOA 1255 was mixed with Group I base oil under typical blending conditions of about 140 degrees F. with agitation until all components were thoroughly mixed. As explained in U.S. Pat. No. 5,726,133, OLOA 1255 is one of the most widely sold gas engine oil additive packages and lubricating oil comprising OLOA 1255 represents a "benchmark standard" against which other formulations useful as engine oils may be measured.

Sample I was prepared by combining about 2 wt. % sulfurized isobutylene, about 6.61 wt. % dispersant, detergent, wear inhibitor and foam inhibitor package and Group I base oil and agitating until all components were mixed. The ingredients were combined at a temperature sufficient to blend the components but not high enough to degrade the components. A temperature of about 140 degrees F. was used.

Sample J was prepared by combining about 2 wt. % sulfurized isobutylene, about 6.61 wt. % of an additive package comprising dispersant, detergent, wear inhibitor and foam inhibitor with Group II base oil and agitating until all components were mixed. The ingredients were combined at a temperature sufficient to blend the components but not high enough to degrade the components. A temperature of about 140 degrees F. was used.

Sample K was prepared by combining about 1.0 wt. % butylated hydroxy toluene, about 6.61 wt. % of an additive package comprising dispersant, detergent, wear inhibitor and foam inhibitor with Group I base oil and agitating until all components were mixed. The ingredients were combined at a temperature sufficient to blend the components but not high enough to degrade the components. A temperature of about 140 degrees F. was used.

Sample L was prepared by combining about 1.0 wt. % butylated hydroxy toluene and about 6.61 wt. % of an additive package comprising dispersant, detergent, wear inhibitor and foam inhibitor with Group II base oil and agitating until all components were mixed. The ingredients were combined at a temperature sufficient to blend the components but not high enough to degrade the components. A temperature of about 140 degrees F. was used.

Example 1

The Oxidation-Nitration and Viscosity Increase Resistance Test

The Oxidation-Nitration and Viscosity Increase Resistance bench test demonstrates the capacity of lubricating oil to resist oxidation, nitration and viscosity increase. This test is a tool to help determine the performance of oils as they relate to the actual service of lubricating engines that use natural gas as a fuel source. The level of oxidation and nitration of oil, may also be compared by monitoring the viscosity increase of the oil. The lower the values for oxidation, nitration and viscosity increase at the end the test, the more superior the product's performance. The Oxidation-Nitration and Viscosity Increase Resistance bench test was designed to simulate Caterpillar 3500 series engine conditions as related to actual field performance of the Caterpillar 3516 model. Oxidation-Nitration and Viscosity Increase Resistance tests were performed on Samples A through G. The samples were placed in a heated glassware bath and subjected to calibrated levels of nitrous oxide gas over a specific period of time. The tests were run on each sample in duplicate and the results are an average of the two runs. The samples were evaluated using differential infra red spectroscopy before placing them in the heated glassware bath to determine a base line for each sample. The samples were re-evaluated at the end of testing period. The differential between the base line data, absorbance units at 5.8 and 6.1 microns, and the data taken at the end of test cycle provides an indication of the oxidation-nitration resistance of the samples.

Differential infra red spectroscopy measures the amount of light that is absorbed by an oil sample and provides a unit of measure called an absorbance unit. DIR (Differential Infrared) spectra was determined by subtracting the fresh oil spectra from the used oil spectra to observe changes that have occurred due to oxidation, nitration, fuel dilution, soot accumulation, and or contamination. Typically a 0.1 millimeter (mm) cell is used, however an ATR crystal setup may be used after determining its associated path length. If the instrument does not have software that determines path length, the path length may be back calculated by measuring oxidation with a calibrated 0.1 mm cell. The variation between ATR and vertical cell measurements is minimal if restricted to the narrow area of oxidation and nitration (−1725 to 1630 $cm^{1}$).

DIR Oxidation was measured from peak maximum at ~1715±5 $cm^{-1}$ to the spectra baseline (in units of absorbance).

DIR Nitration was measured from peak maximum at ~1630±1 $cm^{-1}$ to peak baseline (in units of absorbance).

TABLE 3
Infrared Spectra
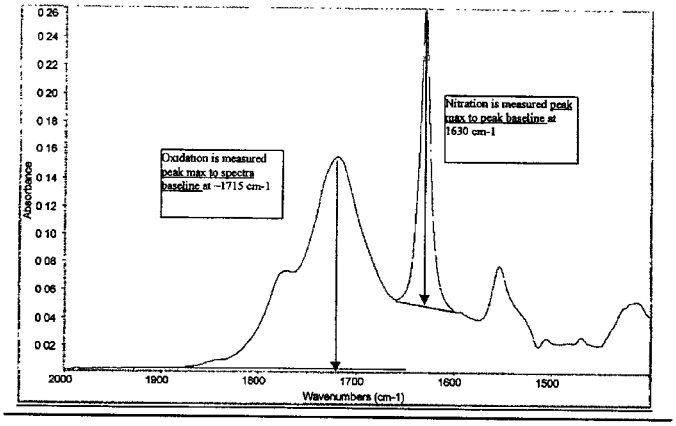

Oxidation (&/or Nitration) Number Reported (abs/cm)= peak absorbance divided by path length in $cm^{-1}$ (report in whole numbers)

During the Oxidation-Resistance Bench Test, the viscosity increases of the samples were measured at 100° C. by ASTM D 445. The viscosity increase is a percentage that compares the initial "fresh" kinematic viscosity with the end of test "used" oil kinematic viscosity. The formula to calculate for % viscosity difference is:

$$\%\ \text{Viscosity difference}=(\text{Sample(x)}_{initial}-\text{Sample(x)}_{final})/\text{Sample(x) initial}\times 100\%$$

Oxidation levels of 5.8 microns and Nitration levels of 6.1 microns were used as peak height comparisons.

(a) Comparison of Samples A, B, C, D, E, F, G

Measurements are reported on a relative measurement basis so that large results or values represent greater levels of oxidation-nitration and viscosity increase resistance. Lower numbers represent shorter oil life. Sample A was used as a reference oil and the results in the Tables 4–6 were reported as a ratio in the first row of each table. This ratio was calculated by dividing measurements for Sample A by the measurements taken using the sample being compared to Sample A. The second row of each table displays the percent difference between the reference Sample A and the samples being compared to Sample A. The larger the percentage difference between Sample A and the other samples, the better performing the sample in respect to parameter being compared. Sample A was the reference sample for the results reported in Table 4–6. The formula to calculate percentage difference of the ratios compared to Sample A for Tables 4–6 is:

$$\%\ \text{difference}=(\text{Sample }(x)-\text{Sample }A)/\text{Sample }(x)\times 100\%$$

TABLE 4

Oxidation Resistance Test Results

| | Sample A | Sample B | Sample C | Sample D | Sample E | Sample F | Sample G |
|---|---|---|---|---|---|---|---|
| Ratio* | 1.00 | 1.32 | 1.39 | 1.25 | 1.78 | 1.02 | 1.22 |
| % Difference compared to Sample A** | 0 | 24 | 28 | 20 | 44 | 2 | 18 |

*Ratio - These numbers are relative ratios compared to Sample A's performance in this test. Numbers larger than 1.00 perform better than Sample A and less than 1.00 perform worse than the reference. The higher the ratio number, the higher the performance of the sample.
**% Difference - These numbers are the percentage differences between Sample A and the comparative Sample. A negative number indicates worse performance than Sample A.

The results presented in Table 4 indicate that Samples B through G exhibited at least a 2% to 44% improvement in oxidation resistance over the reference Sample A. Sample E performed better in oxidation resistance than any other sample tested.

TABLE 5

Nitration Resistance Test Results

| | Sample A | Sample B | Sample C | Sample D | Sample E | Sample F | Sample G |
|---|---|---|---|---|---|---|---|
| Ratio* | 1.00 | 1.60 | 1.02 | 1.33 | 1.88 | 1.43 | 1.32 |
| % Difference compared to Sample A** | 0 | 38 | 2 | 25 | 47 | 30 | 24 |

*Ratio - These numbers are relative ratios compared to Sample A's performance in this test. Numbers larger than 1.00 perform better than Sample A and less than 1.00 perform worse than the reference. The higher the ratio number, the higher the performance of the sample.
**% Difference - These numbers are the percentage differences between Sample A and the comparative Sample. A negative number indicates worse performance than Sample A The results in Table 5 indicate improved performance of Samples B through H over the reference sample A. The improvement ranged from 2% to 47% over the reference Sample A in nitration resistance. Again, Sample E performed better with respect to nitration resistance than all the other samples tested.

TABLE 6

Viscosity Increase Resistance Test Results

| | Sample A | Sample B | Sample C | Sample D | Sample E | Sample F | Sample G |
|---|---|---|---|---|---|---|---|
| Ratio* | 1.00 | 1.19 | 1.58 | 1.38 | 1.70 | 1.02 | 1.24 |
| % Difference compared to Sample A** | 0 | 16 | 37 | 28 | 41 | 2 | 19 |

*Ratio - These numbers are relative ratios compared to Sample A's performance in this test. Numbers larger than 1.00 perform better than Sample A and less than 1.00 perform worse than the reference. The higher the ratio number, the higher the performance of the sample.
**% Difference - These numbers are the percentage differences between Sample A and the comparative Sample. A negative number indicates worse performance than Sample A.

The results in Table 6 indicate that Samples B through G performed better than reference Sample A. The improvement ranged from 2% to 41% over the reference sample in viscosity increase resistance.

Sample E performance was better than the reference sample with respect to oxidation, nitration and viscosity increase. Sample E performed better than all the samples tested with respect to minimizing the levels of oxidation, nitration and viscosity increase. These tests quantify a lubricating oil's resistance to oxidation, nitration and the resultant viscosity increase and are used to determine whether samples are good candidates for extending the life of lubricating oil particularly those lubricating oils for use in natural gas fueled engines. Absorbing oxygen and nitrogen and the resultant viscosity increase associated with absorbing oxygen and nitrogen are undesirable for lubricating oil particularly lubricating oils for use in natural gas fueled engines.

(b) Comparison of Samples I and K

The Oxidation-Nitration and Viscosity Increase Resistance bench test demonstrates the capacity of lubricating oil to resist oxidation, nitration and viscosity increase. The Oxidation-Nitration and Viscosity Increase Resistance tests described in Example 1 were performed on Samples I and K.

Measurements are reported on a relative measurement basis so that large results or values represent greater levels of oxidation-nitration and viscosity increase resistance. Lower numbers represent shorter oil life. Sample K was used as a reference oil and the results in the Tables 7–9 were reported as a ratio in the first row of each table. This ratio was calculated by dividing measurements for Sample K by the measurements taken using the sample being compared to Sample K. The second row of each table displays the percent difference between the reference Sample K and Sample I being compared to Sample I. The larger the percentage difference between Sample K and Sample I, the better performing the sample in respect to parameter being compared. Sample K was the reference sample for the results reported in Table 7–9. The formula to calculate percentage difference of the ratios compared to Sample K for Tables 7–9 is:

$$\%\ \text{difference}=(\text{Sample }(x)-\text{Sample }K)/\text{Sample }(x)\times 100\%$$

TABLE 7

Oxidation Resistance Test Results

| | Sample K | Sample I |
|---|---|---|
| Ratio* | 1.00 | 1.76 |
| % Difference compared to Sample K** | 0 | 43 |

*Ratio - These numbers are relative ratios compared to Sample K's performance in this test. Numbers larger than 1.00 perform better than Sample K and less than 1.00 perform worse than the reference. The higher the ratio number, the higher the performance of the sample.
**% Difference - These numbers are the percentage differences between Sample K and the comparative Sample. A negative number indicates worse performance than Sample K.

The results presented in Table 7 indicate that Sample I exhibited a 43% improvement in oxidation resistance over the reference Sample K.

TABLE 8

Nitration Resistance Test Results

| | Sample K | Sample I |
|---|---|---|
| Ratio* | 1.00 | 1.96 |
| % Difference compared to Sample K** | 0 | 49 |

*Ratio - These numbers are relative ratios compared to Sample K's performance in this test. Numbers larger than 1.00 perform better than Sample K and less than 1.00 perform worse than the reference. The higher the ratio number, the higher the performance of the sample.
**% Difference -These numbers are the percentage differences between Sample K and the comparative Sample. A negative number indicates worse performance than Sample K.

The results presented in Table 8 indicate that Sample I exhibited a 43% improvement in nitration resistance over the reference Sample K.

TABLE 9

Viscosity Increase Resistance Test Results

| | Sample K | Sample I |
|---|---|---|
| Ratio* | 1.00 | 1.73 |
| % Difference compared to Sample K** | 0 | 42 |

*Ratio - These numbers are relative ratios compared to Sample K's performance in this test. Numbers larger than 1.00 perform better than Sample K and less than 1.00 perform worse than the reference. The higher the ratio number, the higher the performance of the sample.
**% Difference - These numbers are the percentage differences between Sample K and the comparative Sample. A negative number indicates worse performance than Sample K.

The results presented in Table 9 indicate that Sample I exhibited a 42% improvement in viscosity increase resistance over the reference Sample K.

Sample I performance was better than the reference sample with respect to oxidation, nitration and viscosity increase. Sample I performed better than Sample K tested with respect to minimizing the levels of oxidation, nitration and viscosity increase.

(c) Comparison of Samples J and L

The Oxidation-Nitration and Viscosity Increase Resistance bench test demonstrates the capacity of lubricating oil to resist oxidation, nitration and viscosity increase. This test is the same as described in Example 1. Oxidation-Nitration and Viscosity Increase Resistance tests were performed on Samples J and L. The test was run and analyzed as described in Example 1. Samples J and L were tested in the test described in Example 1. The oxidation and nitration of the samples were analyzed using differential IR as described in Example 1. Viscosity Increase of the samples was monitored by using the Viscosity Increase test described in Example 1.

Measurements are reported on a relative measurement basis so that large results or values represent greater levels of oxidation-nitration and viscosity increase resistance. Lower numbers represent shorter oil life. Sample L was used as a reference oil and the results in the Tables 10–12 were reported as a ratio in the first row of each table. This ratio was calculated by dividing measurements for Sample L by the measurements taken using the sample being compared to Sample L. The second row of each table displays the percent difference between the reference Sample L and Sample J being compared to Sample J. The larger the percentage difference between Sample L and Sample J, the better performing the sample in respect to parameter being compared. Sample L was the reference sample for the results reported in Table 10–12. The formula to calculate percentage difference of the ratios compared to Sample L for Tables 10–12 is:

$$\%\ \text{difference}=(\text{Sample }(x)-\text{Sample }L)/\text{Sample }(x)\times 100\%$$

TABLE 10

Oxidation Resistance Test Results

| | Sample L | Sample J |
|---|---|---|
| Ratio* | 1.00 | 1.55 |
| % Difference compared to Sample L** | 0 | 36 |

*Ratio - These numbers are relative ratios compared to Sample L's performance in this test. Numbers larger than 1.00 perform better than Sample L and less than 1.00 perform worse than the reference. The higher the ratio number, the higher the performance of the sample.
**% Difference - These numbers are the percentage differences between Sample L and the comparative Sample. A negative number indicates worse performance than Sample L.

The results presented in Table 10 indicate that Sample J exhibited a 36% improvement in oxidation resistance over the reference Sample L.

TABLE 11

Nitration Resistance Test Results

| | Sample L | Sample J |
|---|---|---|
| Ratio* | 1.00 | 5.42 |
| % Difference compared to Sample L** | 0 | 82 |

*Ratio - These numbers are relative ratios compared to Sample L's performance in this test. Numbers larger than 1.00 perform better than Sample L and less than 1.00 perform worse than the reference. The higher the ratio number, the higher the performance of the sample.
**% Difference - These numbers are the percentage differences between Sample L and the comparative Sample. A negative number indicates worse performance than Sample L.

The results presented in Table 11 indicate that Sample J exhibited a 82% improvement in nitration resistance over the reference Sample L.

TABLE 12

Viscosity Increase Resistance Test Results

| | Sample L | Sample J |
|---|---|---|
| Ratio* | 1.00 | 3.38 |
| % Difference compared to Sample L** | 0 | 70 |

*Ratio - These numbers are relative ratios compared to Sample L's performance in this test. Numbers larger than 1.00 perform better than Sample L and less than 1.00 perform worse than the reference. The higher the ratio number, the higher the performance of the sample.
**% Difference - These numbers are the percentage differences between Sample L and the comparative Sample. A negative number indicates worse performance than Sample L.

The results presented in Table 12 indicate that Sample J exhibited a 70% improvement in viscosity increase resistance over the reference Sample L.

Sample J performance was better than the reference Sample L with respect to oxidation, nitration and viscosity increase.

These tests quantify a lubricating oil's resistance to oxidation, nitration and the resultant viscosity increase and are used to determine whether samples are good candidates for extending the life of lubricating oil particularly those lubricating oils for use in natural gas fueled engines. Absorbing oxygen and nitrogen and the resultant viscosity increase associated with absorbing oxygen and nitrogen are undesirable for lubricating oil particularly lubricating oils for use in natural gas fueled engines.

Example 2

Comparing Samples E and H

Because the Caterpillar 3500 series natural gas fueled engines are one of the most commonly used and one of the most severe engines with respect to oil life, they were used as a tool to determine the life of lubricating oil. These tests were run in the same Caterpillar 3512 engine to minimize the amount of variables that are introduced in the testing environment. Oil life as used herein is the length of time it takes for a lubricating oil to reach Caterpillar's condemning limits for natural gas fueled engine lubricating oil. At the time of testing the Caterpillar limits are presented in Table 13.

TABLE 13

| Caterpillar Limits at Time of Testing | |
|---|---|
| Test | Caterpillar Limit |
| Oxidation | 25 abs/cm$^{-1}$ by differential infra red spectroscopy |
| Nitration | 25 abs/cm$^{-1}$ by differential infra red spectroscopy |
| Viscosity Increase | 3 cSt increase over fresh oil |
| Total Base Number (TBN) | 50% of fresh oil TBN by ASTM D2896 |
| Total Acid Number (TAN) | 2.0 number increase over the fresh oil or 3.0 maximum TAN by ASTM D664 |

Both samples were run in the Caterpillar 3512 until the condemning limits were exceeded. The oxidation and nitration of the samples were analyzed using differential IR as described in Example 1. Viscosity Increase of the samples was monitored. The Viscosity Increase analysis is described in Example 1. Sample E exhibited better performance with respect to oxidation, nitration and viscosity increase than Sample H. Total Base Number (TBN) and Total Acid Number (TAN) analyses were also performed. TBN refers to the amount of base equivalent to milligrams of KOH in one gram of sample. Thus, higher TBN numbers reflect more alkaline products, and therefore a greater alkalinity reserve. The TBN of a sample may be determined by ASTM Test No. D2896. TAN refers to the amount of acid equivalent to milligrams of Potassium Hydroxide (KOH) in 1 gram of sample. TAN was determined by the procedure described in ASTM D664.

Samples E and H were tested separately by using each one as a lubricant in the same Caterpillar 3512 natural gas fueled engine for a total time of over 5 months. The oxidation and nitration of the samples were analyzed using differential IR as described in Example 1. Viscosity Increase of each sample was monitored by using the Viscosity Increase test described in Example 1. Total Base Number (TBN) and Total Acid Number (TAN) analyses were also performed as described above.

Sample E oil life performance was better than that of Sample H. Both samples were formulated in Group I base oil. TBN and TAN performance are parameters that are typically used to decide when to condemn lubricating oil. Sample E had an increased oil life of 75% and 79%, respectively, when compared to Sample H.

The calculation formula for Relative Percent Improvement for Table 14 is:

Relative Percent Improvement=(Sample *E*−Sample *H*)/Sample *H*×100% of sulfurized isobutylene in a finished oil formulation.

TABLE 14

| | Sample E | Sample H |
|---|---|---|
| Hours to Reach Caterpillar Limit for Oxidation | 1100 | 900 |
| Relative Percent Improvement Comparison to Sample H for Oxidation | 22.2 | 0 |
| Hours to Reach Caterpillar Limit for Nitration | 1250 | 855 |
| Relative Percent Improvement Comparison to Sample H for Nitration | 46.7 | 0 |
| Hours to Reach Caterpillar Limit for Viscosity Increase | 1085 | 900 |

TABLE 14-continued

| | Sample E | Sample H |
|---|---|---|
| Relative Percent Improvement Comparison to Sample H for Viscosity Increase | 20.6 | 0 |
| Hours to Reach Caterpillar Limit for TBN | 1175 | 670 |
| Relative Percent Change Improvement Comparison to Sample H for TBN | 75.4 | 0 |
| Hours to Reach Caterpillar Limit for TAN | 1300 | 725 |
| Relative Percent Improvement Comparison to Sample H for TAN | 79.3 | 0 |

These results demonstrate that the lubricating oil compositions comprising the antioxidant system of this invention show high resistance to oxidation, nitration and viscosity increase.

While the invention has been described in terms of various embodiments, the skilled artisan will appreciate that various modifications, substitutions, omissions and changes may be made without departing from the spirit thereof.

What is claimed is:

1. An antioxidant system comprising sulfurized isobutylene and one or more hindered phenols wherein the hindered phenols comprise:

butylated hydroxy toluene; or 3,5-di-t-butyl 4-hydroxy phenol propionate, $C_7$–$C_9$ alkyl ester; or mixtures or combinations thereof.

2. An antioxidant system comprising sulfurized isobutylene and one or more hindered phenols wherein the hindered phenols comprise butylated hydroxy toluene.

3. An antioxidant system comprising sulfurized isobutylene and one or more hindered phenols wherein one or more hindered phenols have the general formula:

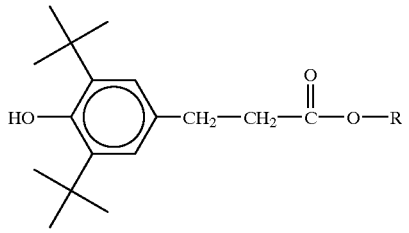

wherein R is a $C_7$ to $C_9$ alkyl group.

4. An antioxidant system of claim 3, wherein the antioxidant system further comprises butylated hydroxy toluene.

5. An antioxidant system comprising sulfurized isobutylene and one or more hindered phenols wherein the one or more hindered phenols comprise 3,5-di-t-butyl 4-hydroxy phenol propionate, $C_7$–$C_9$ alkyl ester.

6. Lubricating oil comprising a base oil and the antioxidant of claim 1.

7. Lubricating oil comprising a base oil and the antioxidant system of claim 2.

8. Lubricating oil comprising a base oil and the antioxidant system of claim 3.

9. Lubricating oil comprising a base oil and the antioxidant system of claim 4.

10. A method of lubricating engines comprising contacting the lubricating oil of claim 6 with one or more engines.

11. A method of lubricating engines comprising lubricating one or more engines with the lubricating oil of claim 7.

12. A method of lubricating engines comprising contacting one or more engines with the lubricating oil of claim 8.

13. A method of lubricating engines comprising contacting one or more engines with lubricating oil of claim 9.

14. A method of claim 13 wherein the engine is a natural gas fueled engine.

15. Lubricating oil comprising:

about 1 wt. % to about 8 wt. % of one or more dispersants;

about 1 wt. % to about 8.5 wt. % of one or more detergents;

about 0.2 wt. % to about 1.5 wt. % of one or more wear inhibitors;

about 0.01 wt. % to about 0.5 wt. % sulfurized isobutylene;

about 0.1 wt. % to about 3 wt. % butylated hydroxy toluene;

and about 0.1 wt. % to about 3 wt. % 3,5-di-t-butyl 4-hydroxy phenol propionate $C_7$–$C_9$ alkyl ester.

16. A method of lubricating engines comprising lubricating one or more engines with the lubricating oil of claim 15.

17. A method of making the lubricating oil of claim 15 comprising combining:

about 1 wt. % to about 8 wt. % of one or more dispersants;

about 1 wt. % to about 8.5 wt. % of one or more detergents;

about 0.2 wt. % to about 1.5 wt. % of one or more wear inhibitors;

about 0.01 wt. % to about 0.5 wt. % sulfurized isobutylene;

about 0.1 wt. % to about 3 wt. % butylated hydroxy toluene; and about 0.1 wt. % to about 3 wt. % 3,5-di-t-butyl 4-hydroxy phenol propionate, $C_7$–$C_9$ alkyl ester in any order.

18. Lubricating oil comprising:

a major amount of one or more base oils;

about 1.25 wt. % to about 6 wt. % of one or more dispersants;

about 2 wt. % to about 6 wt. % of one or more detergents;

about 0.3 wt. % to about 0.8 wt. % of one or more wear inhibitors;

about 0.02 wt. % to about 0.45 wt. % sulfurized isobutylene;

about 0.20 wt. % to about 2.5 wt. % butylated hydroxy toluene; and about 0.20 wt. % to about 2.5 wt. % 3,5-di-t-butyl 4-hydroxy phenol propionate, $C_7$–$C_9$ alkyl ester.

19. A method of lubricating engines comprising contacting one or more engines with the lubricating oil of claim 18.

20. A method of making the lubricating oil of claim 18 comprising combining:

a major amount of one or more base oils;

about 1.25 wt. % to about 6 wt. % of one or more dispersants;

about 2 wt. % to about 6 wt. % of one or more detergents;

about 0.3 wt. % to about 0.8 wt. % of one or more wear inhibitors;

about 0.02 wt. % to about 0.45 wt. % sulfurized isobutylene;

about 0.20 wt. % to about 2.5 wt. % butylated hydroxy toluene; and about 0.20 wt. % to about 2.5 wt. % 3,5-di-t-butyl 4-hydroxy phenol propionate, $C_7$–$C_9$ alkyl ester in any order.

21. Lubricating oil comprising:

about 0.02 wt. % to about 2 wt. % sulfurized isobutylene;

about 1 wt. % to about 8 wt. % of one or more dispersants;

about 1 wt. % to about 8.5 wt. % of one or more of phenates, salicylates and sulfonates;

about 0.2 wt. % to about 1.5 wt. % of one or more wear inhibitors; and one or more of Group I, II, III and IV base oil.

22. A method of making the lubricating oil of claim 21 comprising blending about 0.02 wt. % to about 2 wt. % sulfurized isobutylene;

about 1 wt. % to about 8 wt. % of one or more dispersants;

about 1 wt. % to about 8.5 wt. % of one or more of phenates, salicylates and sulfonates;

about 0.2 wt. % to about 1.5 wt. % of one or more wear inhibitors; and one or more of Group I, II, III and IV base oil in any order with agitation and at a temperature sufficient to blend the components but not high enough to degrade the components.

23. A method of lubricating an engine comprising lubricating the engine with the lubricating oil of claim 21.

24. Lubricating oil comprising:

a major amount of one or more base oils;

about 1.25 wt. % to about 6 wt. % of one or more dispersants;

about 2 wt. % to about 6 wt. % of one or more detergents, about 0.3 wt. % to about 0.8 wt. % of one or more wear inhibitors; and about 0.04 wt. % to about 1.75 wt. % sulfurized isobutylene.

25. A method of making the lubricating oil of claim 24 comprising combining about 1.25 wt. % to about 6 wt. % one or more dispersants;

about 2 wt. % to about 6 wt. % of one or more detergents;

about 0.3 wt. % to about 0.8 wt. % of one or more wear inhibitors; and about 0.04 wt. % to about 1.75 wt. % sulfurized isobutylene in any order.

26. A method of lubricating engines comprising contacting the lubricating oil of claim 24 with one or more engines.

27. The antioxidant system of claim 1 further wherein the concentration ratio of sulfurized isobutylene to hindered phenols is 0.004 to 1.13.

28. The antioxidant system of claim 2 further wherein the concentration ratio of sulfurized isobutylene to hindered phenols is 0.004 to 1.13.

29. The antioxidant system of claim 3 further wherein the concentration ratio of sulfurized isobutylene to hindered phenols is 0.004 to 1.13.

30. The antioxidant system of claim 4 further wherein the concentration ratio of sulfurized isobutylene to hindered phenols is 0.004 to 1.13.

31. The antioxidant system of claim 5 further wherein the concentration ratio of sulfurized isobutylene to hindered phenols is 0.004 to 1.13.

32. The antioxidant system of claim 1 wherein said system is a natural gas engine oil antioxidant system.

33. The antioxidant system of claim 2 wherein said system is a natural gas engine oil antioxidant system.

34. The antioxidant system of claim 3 wherein said system is a natural gas engine oil antioxidant system.

35. The antioxidant system of claim 4 wherein said system is a natural gas engine oil antioxidant system.

36. The antioxidant system of claim 5 wherein said system is a natural gas engine oil antioxidant system.

37. Lubricating oil comprising a base oil and the antioxidant of claim 5.

38. Lubricating oil comprising:

about 1 wt. % to about 8 wt. % of one or more dispersants;

about 1 wt % to about 8.5 wt. % of one or more detergents;

about 0.2 wt. % to about 1.5 wt. % of one or more wear inhibitors;

about 0.01 wt. % to about 0.5 wt. % sulfurized isobutylene;

and about 0.1 wt. % to about 3 wt. % 3,5-di-t-butyl 4-hydroxy phenol propionate, $C_7$–$C_9$ alkyl ester.

39. A method of lubricating engines comprising lubricating one or more engines with the lubricating oil of claim 38.

40. Lubricating oil comprising:

about 1 wt. % to about 8 wt. % of one or more dispersants;

about 1 wt. % to about 8.5 wt. % of one or more detergents;

about 0.2 wt. % to about 1.5 wt. % of one or more wear inhibitors;

about 0.01 wt. % to about 0.5 wt. % sulfurized isobutylene;

and about 0.1 wt. % to about 3 wt. % butylated hydroxy toluene.

41. A method of lubricating engines comprising lubricating one or more engines with the lubricating oil of claim 40.

42. The method of claim 10 wherein the engine is a natural gas fueled engine.

43. The method of claim 11 wherein the engine is a natural gas fueled engine.

44. The method of claim 12 wherein the engine is a natural gas fueled engine.

45. The lubricating oil of claim 15 wherein said lubricating oil is a natural gas engine lubricating oil.

46. The method of claim 16 wherein said engine is a natural gas fueled engine.

47. The lubricating oil of claim 18 wherein said lubricating oil is a natural gas engine lubricating oil.

48. The method of claim 19 wherein said engine is a natural gas fueled engine.

49. The lubricating oil of claim 21 wherein said lubricating oil is a natural gas engine lubricating oil.

50. The method of claim 23 wherein said engine is a natural gas fueled engine.

51. The lubricating oil of claim 24 wherein said lubricating oil is a natural gas engine lubricating oil.

52. The method of claim 26 wherein said engine is a natural gas fueled engine.

53. The lubricating oil of claim 6 wherein said lubricating oil has a total ash content of 0.15 wt. % to 0.6 wt. % as determined by ASTM D874.

54. The lubricating oil of claim 21 wherein said lubricating oil has a total ash content of 0.15 wt. % to 0.6 wt. % as determined by ASTM D874.

55. The lubricating oil of claim 24 wherein said lubricating oil has a total ash content of 0.15 wt. % to 0.6 wt. % as determined by ASTM D874.

56. The lubricating oil of claim 38 wherein said lubricating oil has a total ash content of 0.15 wt. % to 0.6 wt. % as determined by ASTM D874.

57. The lubricating oil of claim 40 wherein said lubricating oil has a total ash content of 0.15 wt. % to 0.6 wt. % as determined by ASTM D874.

* * * * *